US008721477B2

(12) United States Patent
Chung

(10) Patent No.: US 8,721,477 B2
(45) Date of Patent: May 13, 2014

(54) LACROSSE STICK HEAD WITH OPEN-CHANNELED SIDEWALLS

(75) Inventor: Rasyad Chung, Berkeley, CA (US)

(73) Assignee: Easton Sports, Inc., Van Nuys, CA (US)

( * ) Notice: Subject to any disclaimer, the term of this patent is extended or adjusted under 35 U.S.C. 154(b) by 252 days.

(21) Appl. No.: 13/095,749

(22) Filed: Apr. 27, 2011

(65) Prior Publication Data

US 2012/0277038 A1 Nov. 1, 2012

(51) Int. Cl.
*A63B 59/02* (2006.01)
*A63B 65/12* (2006.01)

(52) U.S. Cl.
USPC ..... 473/513; D21/724

(58) Field of Classification Search
USPC ..... 473/505, 512, 513; D21/724
See application file for complete search history.

(56) References Cited

U.S. PATENT DOCUMENTS

| | | | | |
|---|---|---|---|---|
| 7,226,374 | B2 | 6/2007 | Morrow et al. | |
| 7,393,294 | B2 | 7/2008 | Filice et al. | |
| 2008/0026884 | A1 * | 1/2008 | Morrow et al. | 473/513 |
| 2010/0248869 | A1 * | 9/2010 | Lamson et al. | 473/513 |
| 2012/0277038 | A1 * | 11/2012 | Chung | 473/513 |

* cited by examiner

*Primary Examiner* — Gene Kim
*Assistant Examiner* — M Chambers
(74) *Attorney, Agent, or Firm* — Perkins Coie LLP

(57) ABSTRACT

A lacrosse head includes a socket, a base region adjacent to the socket, and a pair of sidewalls extending from the base region to a scoop. A lower rail of each sidewall includes an open channel that is visible from an exterior of the lacrosse head. Multiple support ribs are located in each of the channels and extend from a first wall of the channel to a second wall of the channel. A ball stop extends between the sidewalls adjacent to the base region. A flexible cartridge optionally is positioned between the ball stop and the socket. The support ribs provide increased stiffness near the joint between the ball stop and the socket.

19 Claims, 3 Drawing Sheets

LACROSSE STICK HEAD WITH OPEN-CHANNELED SIDEWALLS

BACKGROUND

Lacrosse stick heads typically include a socket for receiving a stick shaft, a base region adjacent to the socket, and a pair of sidewalls extending from the base region that terminate in a scoop. The sidewalls in many lacrosse heads include an upper rail and a lower rail. Some lacrosse heads, such as those described in U.S. Pat. No. 7,393,294, which is incorporated herein by reference, include a flexible cartridge or joint positioned between the socket and the base for providing increased or variable flexibility to the lacrosse head.

SUMMARY

A lacrosse head includes a socket, a base region adjacent to the socket, and a pair of sidewalls extending from the base region to a scoop. A lower rail of each sidewall includes an open channel. Multiple support ribs are located in each of the channels and extend from a first wall of the channel to a second wall of the channel. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
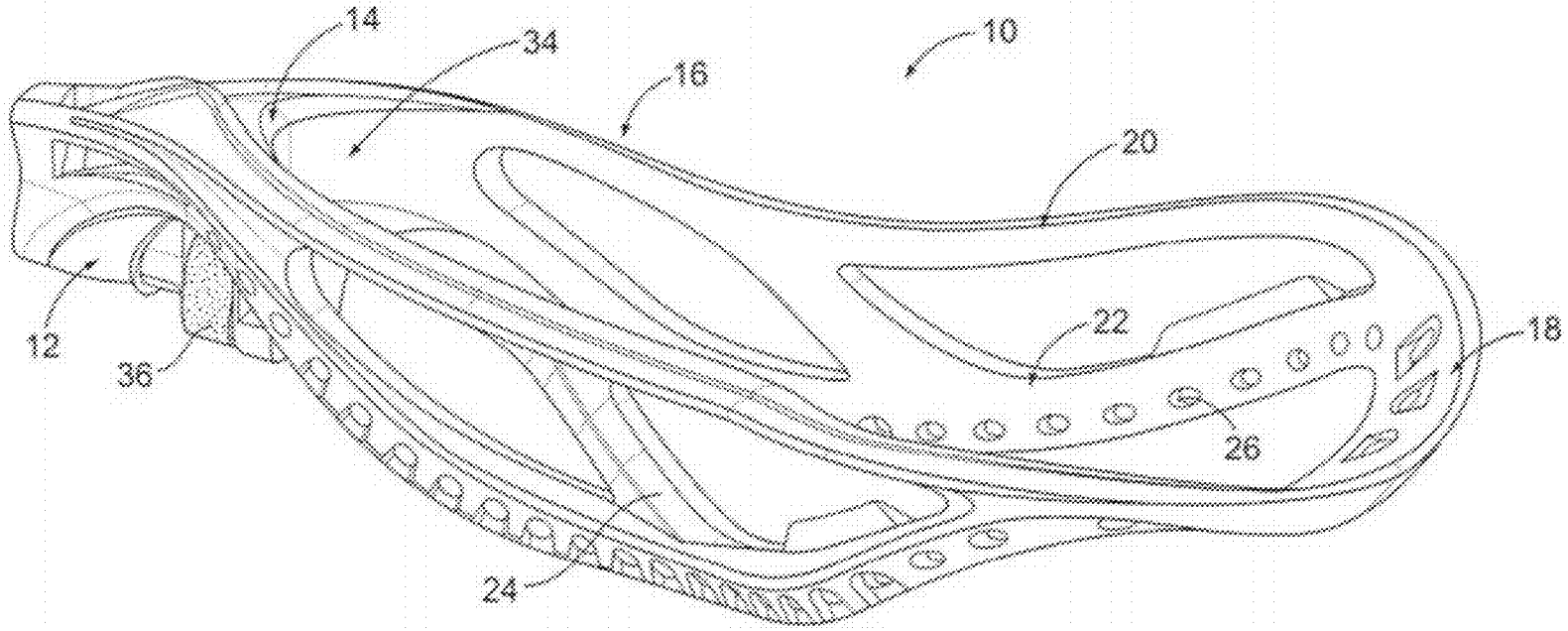
FIG. 1 is a perspective view of a lacrosse head, according to one embodiment.
Figure 2:
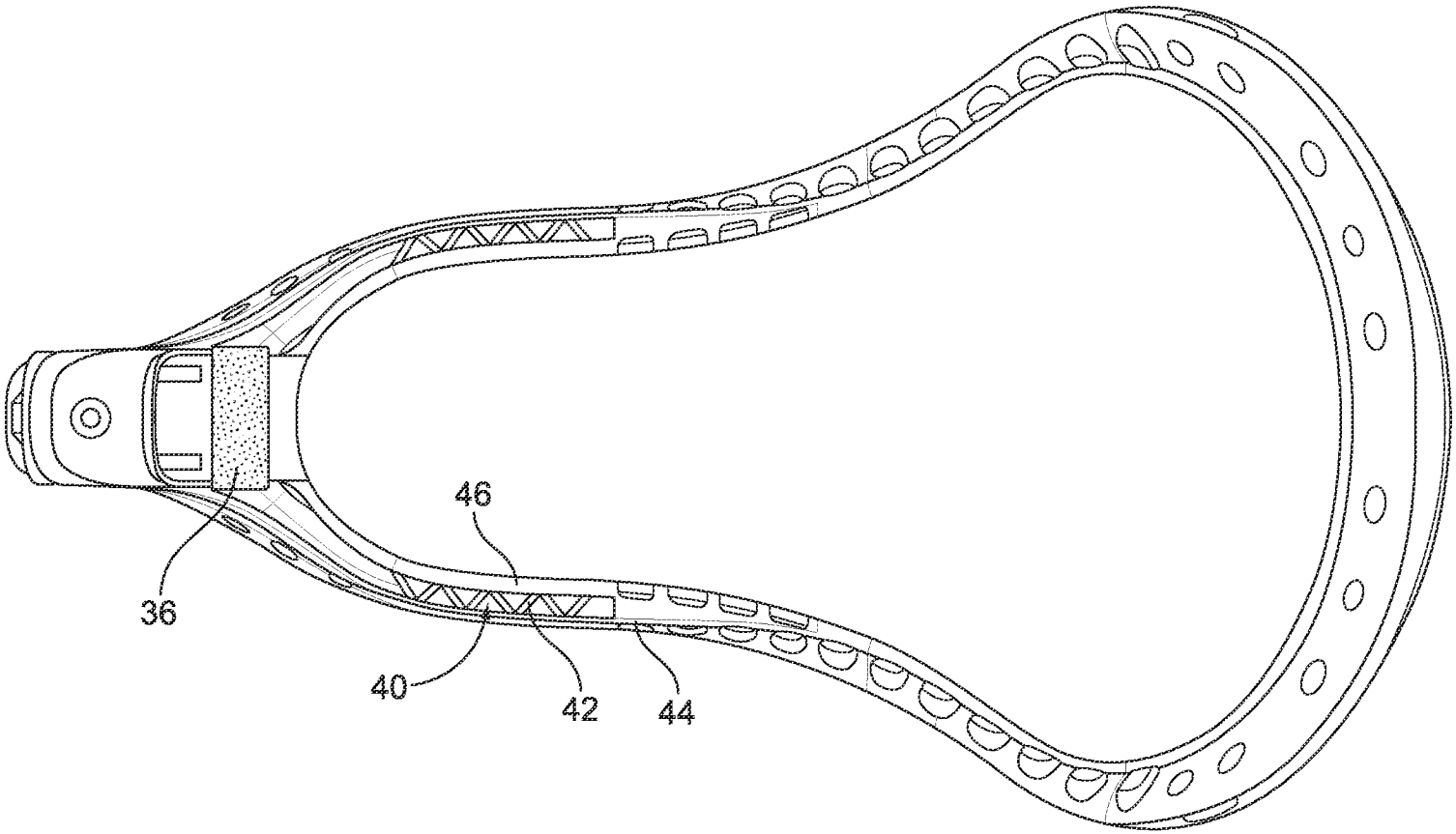
FIG. 2 is a bottom view of the lacrosse head shown in FIG. 1.
Figure 3B:
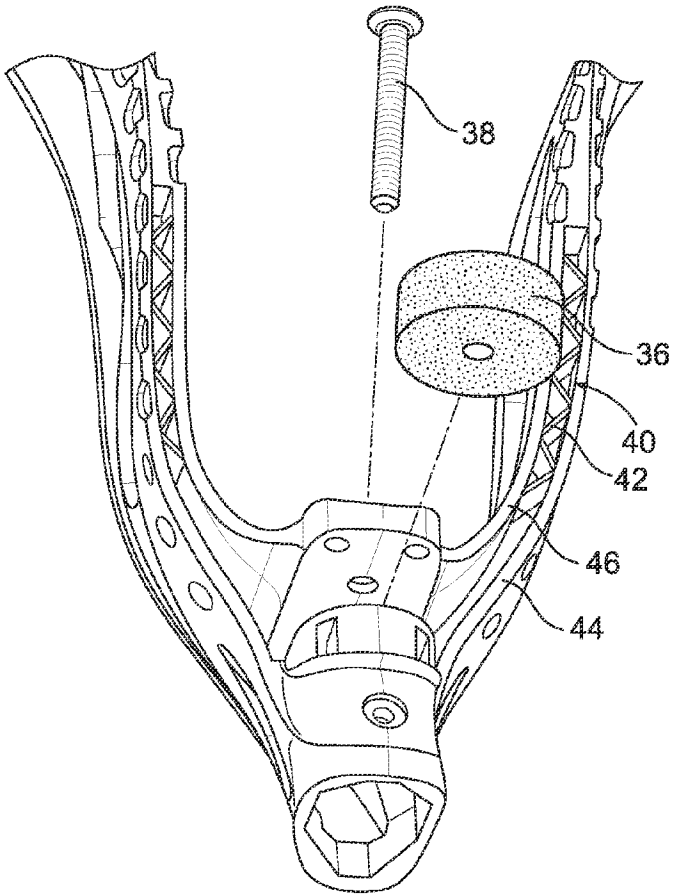
FIG. 3B is an exploded view of the lacrosse head shown in FIG. 3A.
Figure 3A:
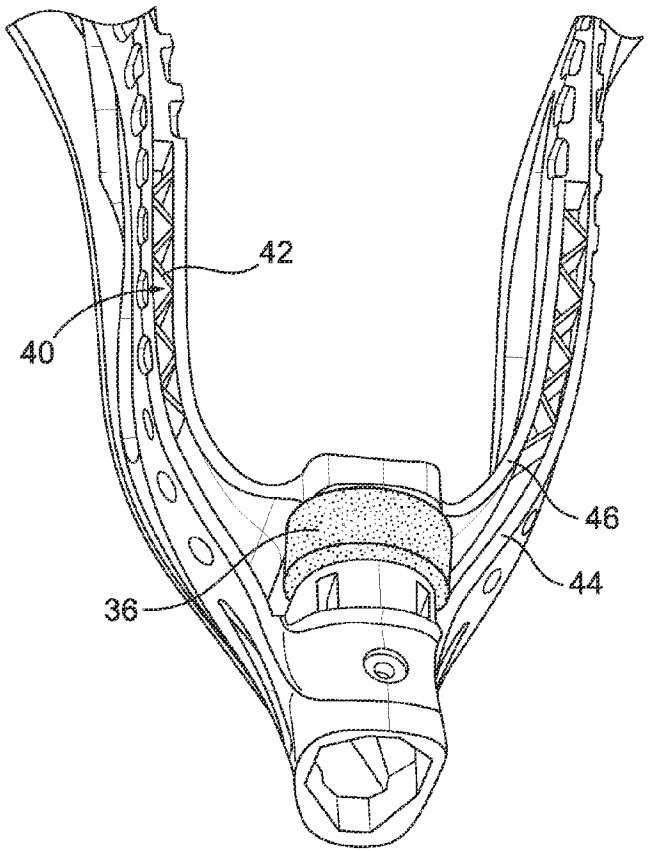
FIG. 3A is a bottom view of the channel regions of the lacrosse head shown in FIGS. 1 and 2.

Turning now in detail to the drawings, as shown in FIGS. 1-3, in one embodiment a lacrosse head 10 includes a socket 12 configured to receive a lacrosse stick shaft, and a base region 14 adjacent to the socket 12. Sidewalls 16 extend from the base region 14 and terminate at a scoop 18. Each sidewall 16 includes an upper rail 20 extending from the base region 14 and a lower rail 22 connected to the upper rail 20 via support arms 24. Eyelets 26 or other openings, to which netting or another lacrosse pocket material may be connected, are included in the lower rails 22. The various lacrosse head components may be made of a plastic material or of another suitable material.

A ball rest or ball stop 34 extends between the sidewalls 16 adjacent to the base region 14. In one embodiment, the ball stop 34 is spaced from the socket 12 such that a cavity is formed between them. A flexible member or cartridge 36 may be positioned between and attached to the ball stop 34 and the socket 12, via a screw 38 or another suitable attachment device. The flexible cartridge 36 may be made of a compressible, resilient rubber material, or of another suitable material. A flexible cartridge 36 of this nature is described in incorporated U.S. Pat. No. 7,393,294.

The screw 38 may be tightened, which compresses the flexible cartridge 36 and adjusts the throwing angle—or the angle between an upper surface of the upper rail 20 and an upper surface of the socket 12—to meet a given player's preferences. The throwing angle may be adjusted in the opposite direction by loosening the screw 38. Tightening or loosening the screw 38 also adjusts the flexibility and feel of the head 10.

Each lower rail 22 includes a channel 40. In one embodiment, the channel 40 is an open channel that is visible from an exterior of the lacrosse head 10. Multiple support ribs 42 extend from a first wall 44 of each channel 40 to a second wall 46 of the channel 40. In the embodiment shown, the support ribs 42 form a truss pattern. The support ribs 42 may alternatively be oriented in any other suitable manner.

In one embodiment, the channels 40 with support ribs 42 are located near the flexible cartridge 36 to provide increased stiffness in the flexible region of the lacrosse head 10. This increased stiffness near the base region 14 of the lacrosse head 10 provides players with additional feel and control. In this embodiment, the channels 40 optionally extend along less than half the length of the lower rails 22. The channels 40 may, for example, extend along approximately 15-30% of the length of the lower rails 22.

Alternatively, the channels 40 may extend along any portion of the length of the lower rails 22, or along the entire length of the lower rails 22, to meet the needs of a given player. If a player desires increased stiffness near the scoop end of the lacrosse head, for example, a channel 40 including support ribs 42 may be located closer to the scoop end, or may extend along a majority or all of the length of the lower rail 22. One or more channels 40 with support ribs 42 may be included in any portion or portions of the lower rails 22 where increased stiffness is desired.

Inclusion of channels 40 may also reduce the weight of the lacrosse head 10 relative to a similarly configured head without channels. This weight reduction could be offset, however, by the thickness or number of support ribs 42 included in the channel 40. Thus, the weight of the lacrosse head may be varied based on the number of support ribs included and on the physical characteristics of the support ribs.

Any of the above-described embodiments may be used alone or in combination with one another. Furthermore, the lacrosse head may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A lacrosse head configured to be attached to a lacrosse stick shaft, comprising:

a socket;

a base region adjacent to the socket;

an upper rail extending from the base region;

a lowermost rail connected to the upper rail, wherein the lowermost rail includes an open channel; and a plurality of support ribs extending from a first wall of the channel to a second wall of the channel and wherein the support ribs are arranged in a truss pattern in the channel.

2. The lacrosse head of claim 1 further comprising a ball stop adjacent to the base region and spaced apart from the socket to form a cavity between the ball stop and the socket, with the lacrosse head further comprising a flexible cartridge positioned between the ball stop and the socket.

3. The lacrosse head of claim 2 wherein the flexible cartridge is attached to the ball stop and the socket via a screw.

4. The lacrosse head of claim 3 wherein the flexible cartridge is compressible via tightening of the screw such that an angle between an upper surface of the upper rail and an upper surface of the socket is adjustable.

5. The lacrosse head of claim 1 wherein the upper rail and the lowermost rail terminate at a scoop at an end of the lacrosse head distal from the base region.

6. The lacrosse head of claim 5, wherein the channel extends less than half the length of the lowermost rail, and wherein the channel is located closer to the base region than to the scoop.

7. The lacrosse head of claim 1 wherein the channel is visible from a lower exterior of the lacrosse head.

8. The lacrosse head of claim 1 comprising two upper rails extending from the base region and two lowermost rails connected to the two upper rails, wherein each of the lowermost rails includes an open channel with a plurality of support ribs extending from a first wall of the channel to a second wall of the channel.

9. A lacrosse head configured to be attached to a lacrosse stick shaft, comprising:

a socket;

a base region adjacent to the socket;

a plurality of sidewalls including an upper surface and extending from the base region to a scoop, wherein a lower region of each of the sidewalls includes an open channel facing opposite the upper surface, wherein the channel is visible from an exterior of the lacrosse head;

a plurality of support ribs in each of the channels extending from a first wall of the channel to a second wall of the channel;

a ball stop extending between the sidewalls adjacent to the base region; and a flexible cartridge positioned between the ball stop and the socket and wherein the support ribs are arranged in a truss pattern in the channel.

10. A lacrosse head configured to be attached to a lacrosse stick shaft, comprising:

a socket at a proximal end of the lacrosse head;

a base region adjacent to the socket;

a plurality of sidewalls including an upper surface and extending from the base region to a distal end of the lacrosse head, wherein a lower region of each of the sidewalls includes an open channel facing opposite the upper surface; and a plurality of support ribs in each of the channels and wherein the support ribs are arranged in a truss pattern in the channel.

11. The lacrosse head of claim 10 further comprising a flexible cartridge positioned between the ball stop and the socket.

12. The lacrosse head of claim 11 wherein the flexible cartridge is attached to the ball stop and the socket via a screw.

13. The lacrosse head of claim 12 wherein the flexible cartridge is compressible via tightening of the screw such that an angle between an upper surface of the sidewalls and an upper surface of the socket is adjustable.

14. The lacrosse head of claim 10 wherein each of the sidewalls comprises an upper rail and a lower rail, wherein each of the lower rails includes an open channel with a plurality of support ribs therein.

15. The lacrosse head of claim 14, wherein each of the channels extends along approximately 15-30% of the length of the lower rail in which it is located, and wherein each of the channels is located closer to the base region than to the distal end of the lacrosse head.

16. The lacrosse head of claim 14 further comprising support arms connecting the upper rails to the lower rails.

17. The lacrosse head of claim 10 wherein the support ribs in each of the channels extend from a first wall of the channel to a second wall of the channel.

18. The lacrosse head of claim 17 wherein the support ribs are arranged in a truss pattern in each of the channels.

19. The lacrosse head of claim 10 further comprising a ball stop extending between the sidewalls adjacent to the base region.

* * * * *